US011149465B2

(12) United States Patent
Burt et al.

(10) Patent No.: US 11,149,465 B2
(45) Date of Patent: Oct. 19, 2021

(54) HORIZONTAL CABLE RAIL BARRIER

(71) Applicant: Fortress Iron, LP, Garland, TX (US)

(72) Inventors: Kevin T. Burt, Dallas, TX (US); Matthew Carlyle Sherstad, Dallas, TX (US)

(73) Assignee: Fortress Iron, LP, Garland, TX (US)

( * ) Notice: Subject to any disclaimer, the term of this patent is extended or adjusted under 35 U.S.C. 154(b) by 98 days.

(21) Appl. No.: 16/745,738

(22) Filed: Jan. 17, 2020

(65) Prior Publication Data

US 2020/0149310 A1 May 14, 2020

Related U.S. Application Data

(63) Continuation of application No. 15/918,752, filed on Mar. 12, 2018, now Pat. No. 10,538,940, which is a (Continued)

(51) Int. Cl.
*E04H 17/16* (2006.01)
*E04H 17/14* (2006.01)
(Continued)

(52) U.S. Cl.
CPC ..... *E04H 17/163* (2013.01); *E04F 11/1859* (2013.01); *E04H 17/1417* (2013.01); *E04H 17/04* (2013.01)

(58) Field of Classification Search
CPC ..... E04F 11/1859; E04H 17/02; E04H 17/04; E04H 17/08; E04H 17/10; E04H 17/12;
(Continued)

(56) References Cited

U.S. PATENT DOCUMENTS 56,766 A * 7/1866 Larmore ..... E04H 17/12 256/58
607,410 A 7/1898 Flanagan et al.
(Continued)

FOREIGN PATENT DOCUMENTS

DE 10 2011 121 073 3/2013
FR 3000531 7/2014
(Continued)

OTHER PUBLICATIONS

International Search Report and Written Opinion on International Application No. PCT/US2021/013775, dated Apr. 7, 2021, 14 pages.
(Continued)

*Primary Examiner* — Josh Skroupa
(74) *Attorney, Agent, or Firm* — Foley & Lardner LLP; John J. May

(57) ABSTRACT

A barrier panel includes first and second vertical rail members, each with a plurality of through holes spaced apart along its length. Top and bottom horizontal rails extend at least from the first vertical rail member to the second vertical rail member, and a first end of the top horizontal rail extends beyond the first vertical rail member in a first direction and a second end of the top horizontal rail opposite the first end extends beyond the second vertical rail member in a second direction opposite the first direction, each end is configured to be coupled to a respective post. A plurality of cables are vertically spaced apart along a length of the first vertical rail member, each cable extends from the first vertical rail member to the second vertical rail member.

20 Claims, 16 Drawing Sheets

Related U.S. Application Data continuation of application No. 14/684,882, filed on Apr. 13, 2015, now Pat. No. 9,976,320.

(60) Provisional application No. 61/979,083, filed on Apr. 14, 2014.

(51) Int. Cl.
*E04F 11/18* (2006.01)
*E04H 17/04* (2006.01)

(58) Field of Classification Search
CPC ... E04H 17/1417; E04H 17/163; E04H 17/24; E04H 17/261
USPC ..... 256/34, 47, 48, 52, 54–56, 65.02
See application file for complete search history.

(56) References Cited

U.S. PATENT DOCUMENTS

| | | | |
|---|---|---|---|
| 753,227 | A | 3/1904 | Bounds |
| 1,714,388 | A | 5/1929 | McBride |
| 3,313,527 | A | 4/1967 | Eriksson |
| 3,955,799 | A | 5/1976 | Lauzier |
| 4,190,234 | A | 2/1980 | Coleman |
| 4,433,831 | A | 2/1984 | Bunger |
| 5,186,497 | A | 2/1993 | Van Pinkerton, Jr. |
| 5,613,664 | A | 3/1997 | Svalbe |
| 5,649,688 | A | 7/1997 | Baker |
| 6,135,424 | A | 10/2000 | Bracke |
| 6,679,480 | B1 | 1/2004 | Hara et al. |
| 6,902,151 | B1 | 6/2005 | Nilsson |
| 6,962,328 | B2 | 11/2005 | Bergendahl |
| 6,964,138 | B2 | 11/2005 | Carroll et al. |
| 7,044,448 | B1 | 5/2006 | Jones |
| 7,168,689 | B2 | 1/2007 | Giralt |
| 7,198,253 | B2 | 4/2007 | Striebel et al. |
| 7,249,908 | B2 | 7/2007 | Bergendahl et al. |
| 7,889,075 | B2 | 2/2011 | Winkler et al. |
| 7,913,983 | B1 | 3/2011 | Sandor, Sr. |
| 7,988,133 | B2 | 8/2011 | Gripne et al. |
| 8,157,471 | B2 | 4/2012 | Bergendahl et al. |
| 8,814,145 | B2 | 8/2014 | Herman |
| 9,145,705 | B2 | 9/2015 | Herman |
| 9,194,155 | B2 | 11/2015 | Landry |
| 9,689,410 | B2 | 6/2017 | Ostervig |
| 9,790,707 | B2 | 10/2017 | Burt et al. |
| 10,450,774 | B2 | 10/2019 | Herman |
| 10,883,290 | B2 | 1/2021 | Burt et al. |
| 2005/0071958 | A1 | 4/2005 | Toimil |
| 2006/0151760 | A1 | 7/2006 | Vyvyan-Vivian |
| 2009/0050865 | A1 | 2/2009 | Napier |
| 2009/0321699 | A1 | 12/2009 | Payne |
| 2010/0012910 | A1 | 1/2010 | Napier |
| 2010/0219390 | A1 | 9/2010 | O'Banion et al. |
| 2010/0278609 | A1 | 11/2010 | Wreford |
| 2010/0288991 | A1 | 11/2010 | Derogatis et al. |
| 2010/0301297 | A1 | 12/2010 | Chapman |
| 2010/0308293 | A1 | 12/2010 | Larkins et al. |
| 2011/0073823 | A1 | 3/2011 | Mitrovic |
| 2011/0109025 | A1 | 5/2011 | Sechler |
| 2012/0168703 | A1 | 7/2012 | Napier |
| 2013/0020546 | A1 | 1/2013 | Truckner |
| 2013/0069026 | A1 | 3/2013 | Bergendahl et al. |
| 2014/0138596 | A1 | 5/2014 | Ross |
| 2014/0332745 | A1 | 11/2014 | Marconi |
| 2015/0041743 | A1 | 2/2015 | Richison et al. |
| 2015/0204104 | A1 | 7/2015 | Ostervig |
| 2015/0252588 | A1 | 9/2015 | Springborn |
| 2016/0083975 | A1 | 3/2016 | Herman |
| 2017/0362854 | A1 | 12/2017 | Burt et al. |
| 2020/0048928 | A1* | 2/2020 | Herman ..... E04F 11/1859 |
| 2020/0080620 | A1 | 3/2020 | Graber et al. |

FOREIGN PATENT DOCUMENTS

| | | | |
|---|---|---|---|
| FR | 3000531 A1 * | 7/2014 | ..... E04F 11/1859 |
| GB | 0 413 928 | 7/1934 | |
| GB | 2 420 544 | 5/2006 | |

OTHER PUBLICATIONS

American Heritage Dictionary, Dictionary Entry: Swage, https://ahdictionary.com/word/search.html?q=swage, 2019, 2 pages.
Cambridge English Dictionary, Definition of "Shank", https://dictionary.cambridge.org/us/dictionary/english/shank, 2019, 1 page.
Extended European Search Report for European Application No. 19182951.4, dated Oct. 25, 2019, 8 pages.
International Search Report and Written Opinion for PCT/US2015/025567 dated Jul. 14, 2015 (13 pages).
Merriam-Webster, Definition of "Shank", http://www.merriam-webster.com/dictionary/shank, 2019, 1 page.

* cited by examiner

HORIZONTAL CABLE RAIL BARRIER

PRIORITY CLAIM

This application is a continuation of U.S. patent application Ser. No. 15/918,752, filed on Mar. 12, 2018, now pending, which is a continuation of U.S. patent application Ser. No. 14/684,882, filed on Apr. 13, 2015, now U.S. Pat. No. 9,976,320, which claims priority to U.S. Provisional Application for Patent No. 61/979,083, filed on Apr. 14, 2014, the disclosures of each of which are incorporated herein by reference.

BACKGROUND OF THE INVENTION

Technical Field of the Invention

The present invention relates generally to barriers (such as railings or fences) and in particular to a barrier panel utilizing cables as horizontal barrier members.

Description of Related Art

It is common to form a barrier for railing or fence applications made, for example, of a plurality of panel members, with each panel member supported between and attached to a pair of post members. Each panel generally comprises a bottom rail extending between two posts and a top rail also extending between those same two posts. A plurality of vertical support members (also referred to in the art as pickets or balusters) extend between the bottom rail and the top rail. The bottom rail, top rail and vertical support members are made of a metal material (such as steel or aluminum). In an embodiment, first ends of the vertical support members are fixedly attached to the bottom rail (for example, through brackets or welding) and second ends of the vertical support members are fixedly attached to the top rail (again, for example, through brackets or welding).

The panel may be pre-assembled before delivery to a job site. In such a case, the installer may simply install the pair of posts with a separation substantially equal to a length of the panel. The installed posts should have an exposed height that is greater than a height of the panel. Brackets mounted on each post accept and retain ends of the bottom and top rails.

SUMMARY

In an embodiment, a barrier panel is formed of a first vertical rail member and a second vertical rail member mounted to and extending between a top rail member. The first vertical rail member includes a first web portion and a pair of leg portions extending from the first web portion, and a second web portion disposed spaced apart from the first web portion and between the pair of leg portions. The first web portion and second web portions define a plurality of aligned through holes. A plurality of horizontal cables are mounted to and extend between the first vertical rail member and second vertical rail member, wherein a first end of each cable is secured within one set of the aligned first and second through holes and a second end of each cable is secured within an opposite one of the third through holes.

In an embodiment, an apparatus comprises: a rail member including: an outer U-shaped channel; and an inner U-shaped channel; wherein said inner U-shaped channel is mounted within the outer U-shaped channel with open ends of the inner and outer U-shaped channels facing each other; inner openings spaced apart along the length of the inner U-shaped channel; and outer openings spaced apart along the length of the outer U-shaped channel; wherein each inner opening is aligned with a corresponding outer opening; and a plurality of cables mounted to said rail member, wherein an end of each cable is secured within aligned inner and outer openings.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION

Figure 1:
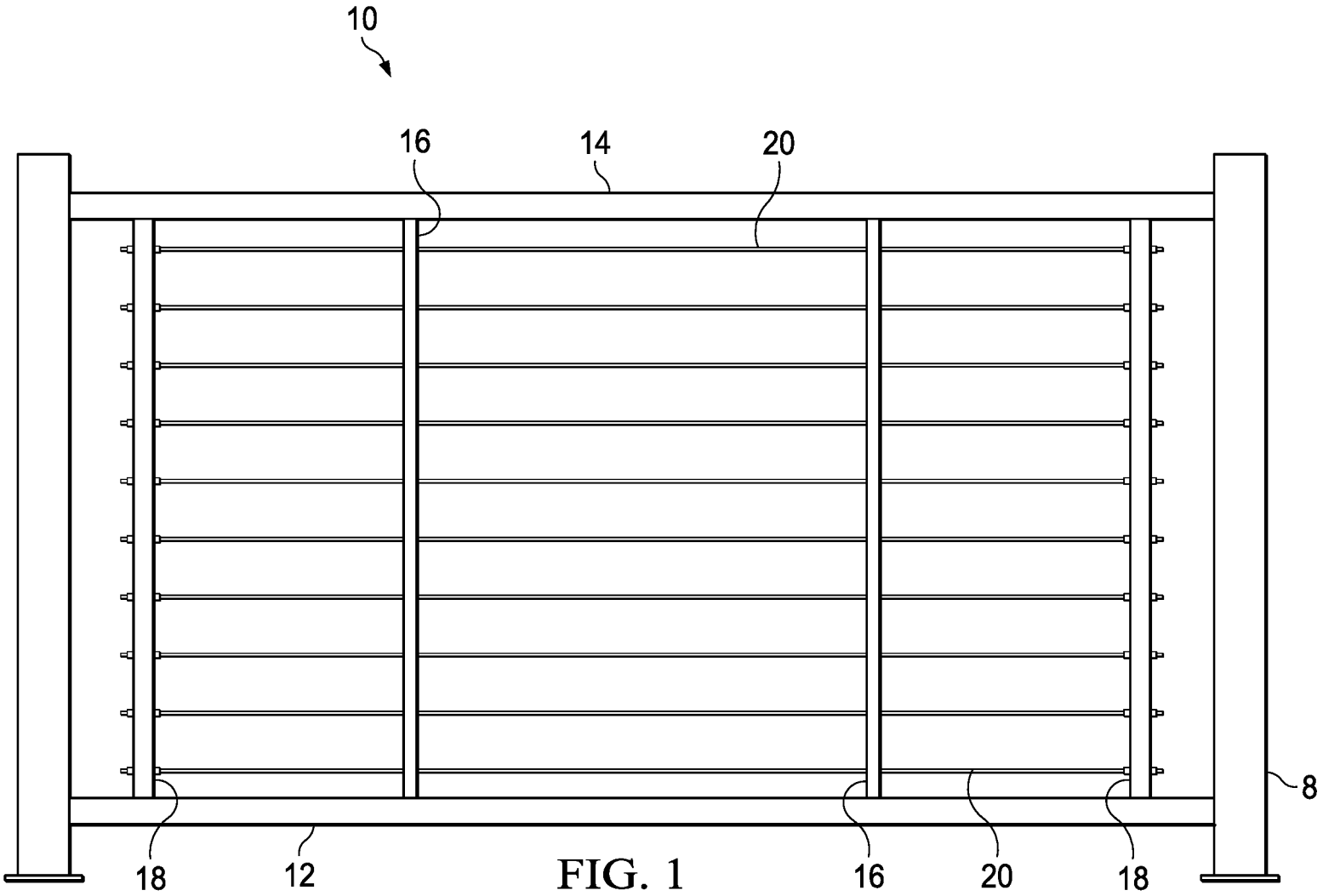
FIG. 1 is a front view of an embodiment of a cable rail panel.

Reference is now made to FIG. 1 which illustrates a front view of an embodiment of a cable rail panel 10 (configured to be installed between two post members 8). The panel 10 includes a bottom rail 12 and a top rail 14 that are spaced apart from each other by vertical members. The vertical members include a pair of vertical support members 16 (extending between the bottom and top rails) and a pair of vertical rails 18 (extending between the bottom and top rails). The vertical members are spaced apart from each other along the lengths of the bottom and top rails. In particular, the vertical support members 16 are positioned at locations between the ends of the rails 12 and 14 while the vertical rails 18 are positioned at or near the ends of the rails 12 and 14. The bottom rail 12, top rail 14, vertical support members 16 and vertical rails 18 are made of a metal material (such as steel or aluminum). First ends of the vertical support members 16 and vertical rails 18 are fixedly attached (for example, by welding, bolts or brackets) to the bottom rail 12. Second ends of the vertical support members 16 and vertical rails 18 are fixedly attached (also, for example, by welding, bolts or brackets) to the top rail 14. The panel 10 further includes a plurality of horizontal cables 20 spaced apart from each other along the lengths of the vertical support members 16 and vertical rails 18 and extending between the vertical rails 18. The means for cable attachment will be discussed in more detail herein. Each end of the bottom and top rails is configured for attachment to the post member 8, for example, through the use of a bracket mechanism as known in the art.

Figure 2:
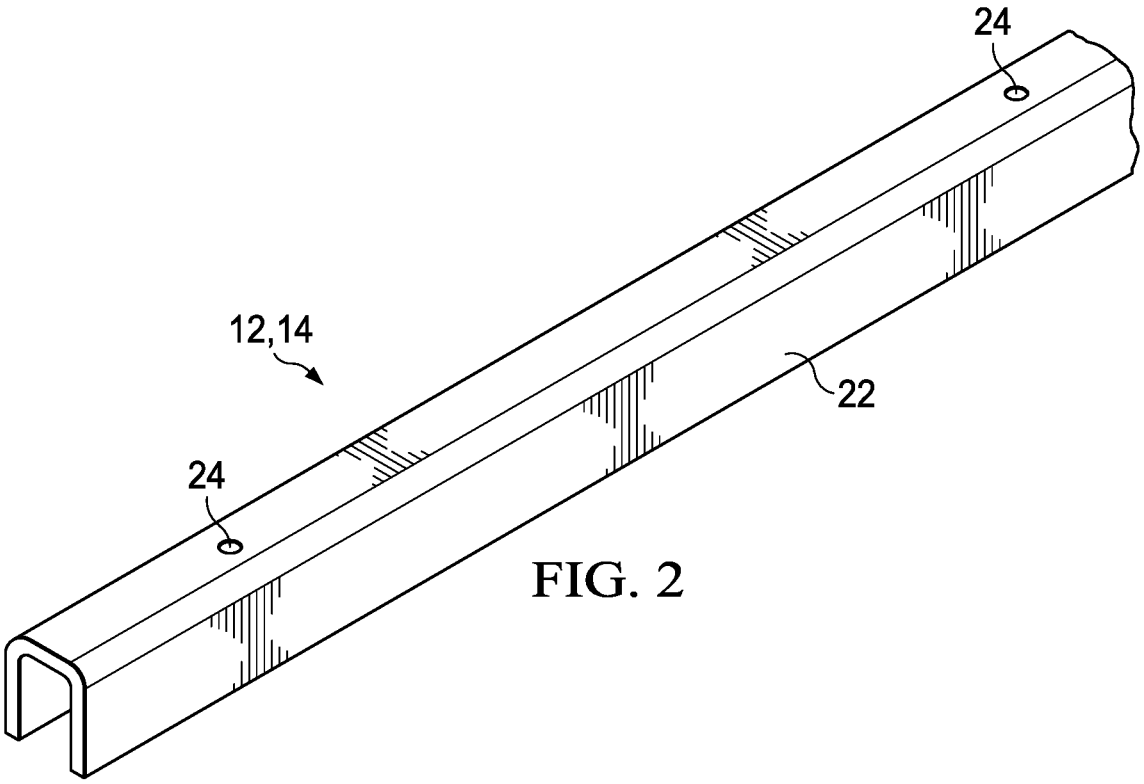
FIG. 2 is a perspective view of a bottom rail and top rail.
Figure 3:
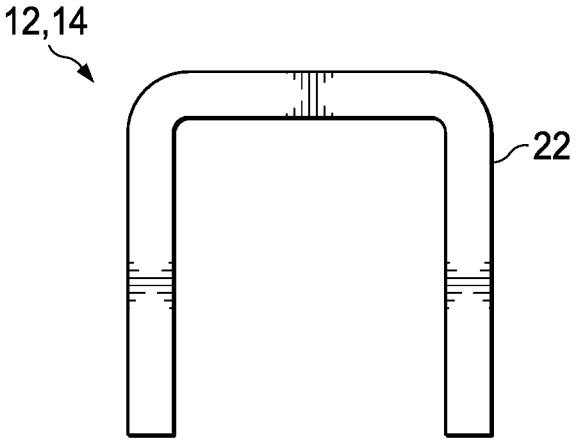
FIG. 3 is an end view of the bottom rail and top rail.

Reference is now made to FIG. 2 which illustrates a perspective view of the bottom rail 12 and top rail 14 and further to FIG. 3 which illustrates an end view of the bottom rail 12 and top rail 14. The rails 12 and 14 are formed of a U-shaped channel member 22. Each channel member 22 is formed of a web member and an opposed pair of leg members extending generally perpendicularly from the web member. The space between the leg members defines the open end of the channel member 22. The web member includes a plurality of openings 24 spaced apart along the length of the channel member 22. When assembled to form the panel 10 (see, FIG. 1), the open end of the channel member 22 for the bottom rail 12 faces down and the open end of the channel member 22 for the top rail 14 faces up. The ends of the rails 12 and 14 and mounted to the post members 8 using the bracket mechanism.

Figure 4:
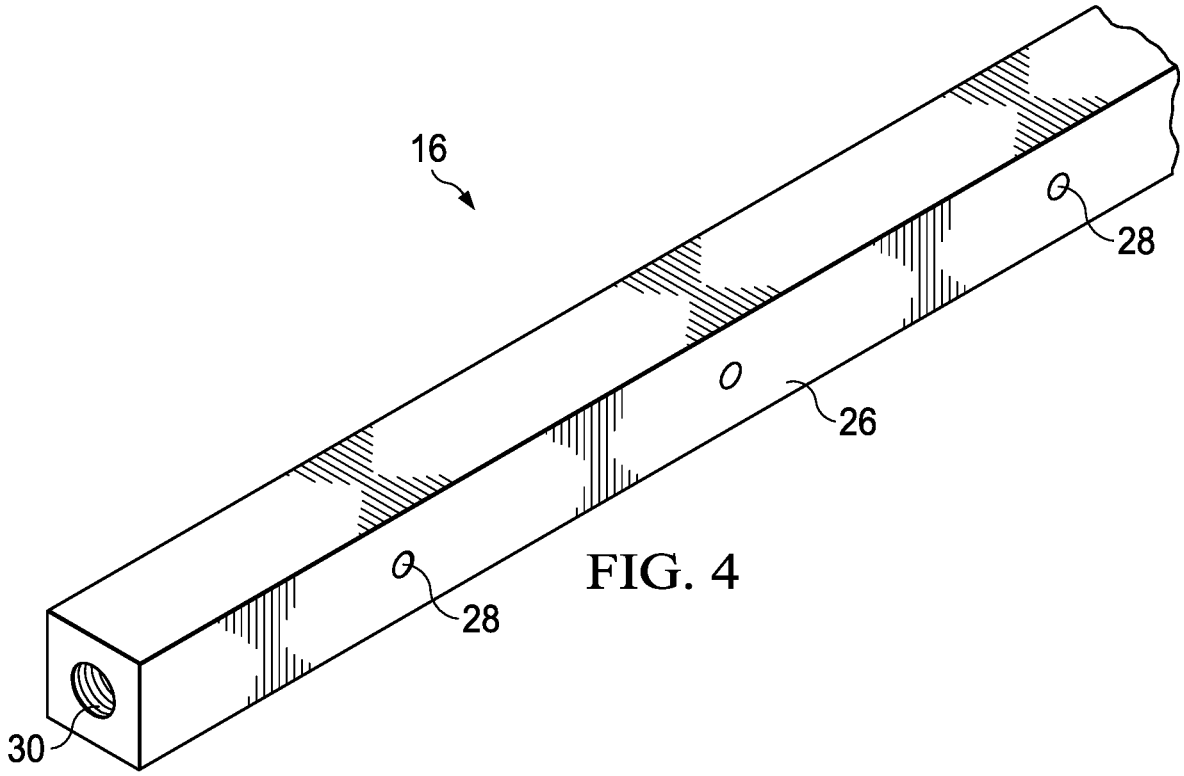
FIG. 4 is a perspective view of a vertical support member.

Reference is now made to FIG. 4 which illustrates a perspective view of the vertical support member 16. In a preferred embodiment, the vertical support member 16 is a solid bar member 26 having a desired cross-section including, for example, square, rectangular, circular, hexagonal, octagonal, or the like. A plurality of openings 28 are provided along the length of the member 16 to pass through the bar member 26. Each end of the bar member 26 includes a threaded opening 30.

In an alternative embodiment, the members 16 are hollow tubular members having a desired cross-section including, for example, square, rectangular, circular, hexagonal, octagonal, or the like. Such a tubular member may include a threaded opening similar to that shown in FIG. 4 at each end.

Figure 5:
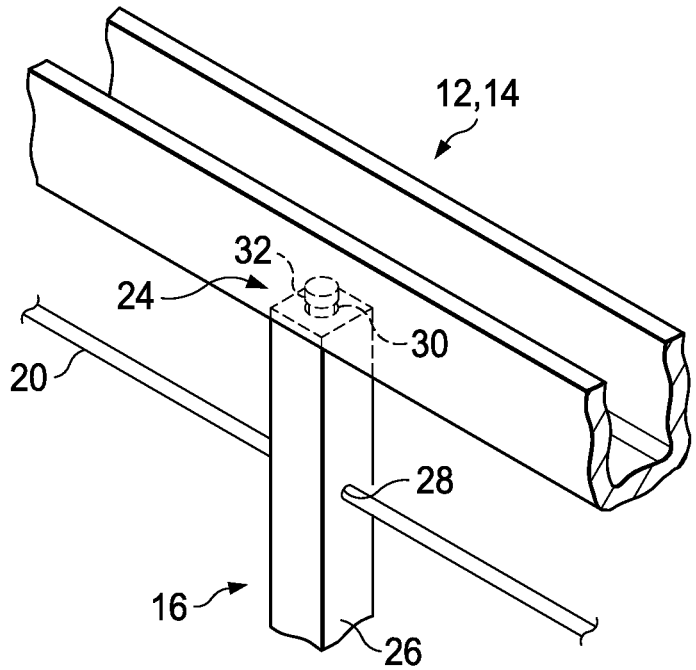
FIG. 5 illustrates details of the assembly of vertical support members to bottom/top rails.

Reference is now made to FIG. 5 which illustrates details of the assembly of the vertical support members 16 to the rails 12 and 14. At selected correspondingly positioned ones of the openings 24 along the length of the rails 12 and 14, attachment is made to opposed ends of each vertical support member 16. Mounting hardware 32 is used to make the attachment. The mounting hardware 32 may, for example, comprise a bolt, screw or other threaded connector as known in the art with the threaded shaft of the hardware extending through the opening 24 in the rail web to engage the threaded opening 30 provided in the vertical support member 16. The openings 28 are oriented to extend in the plane of the panel 10 to permit passage of the cables 20 therethrough.

Figure 6A:
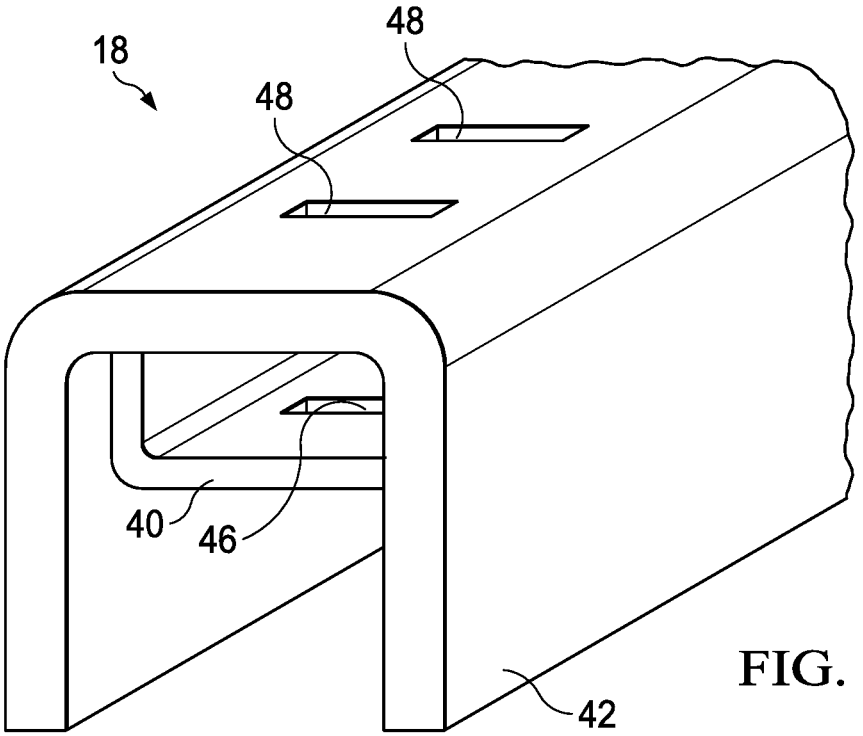
FIGS. 6A-6B and 8 are perspective views of a vertical rail.
Figure 6B:
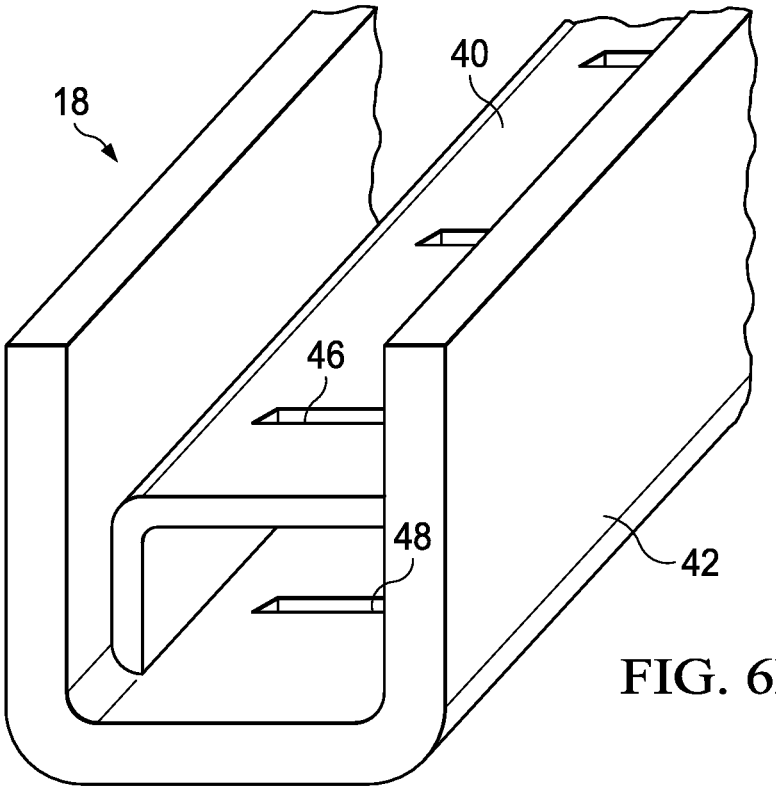
Figure 7:
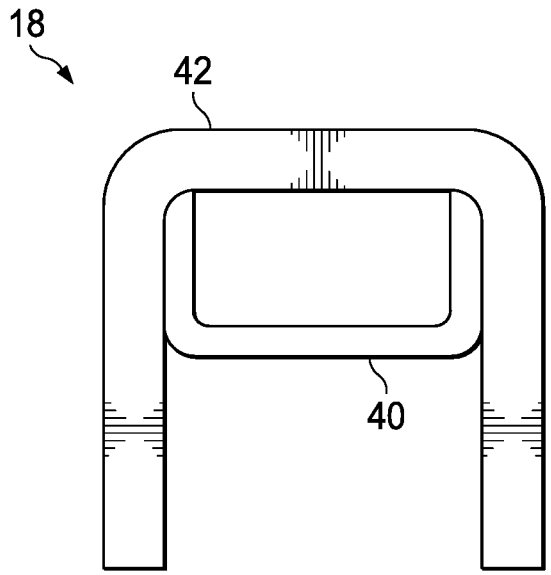
FIG. 7 is a cross-sectional view of the vertical rail.

Reference is now made to FIGS. 6A and 6B which illustrate perspective views of the vertical rail 18 and further to FIG. 7 which illustrates a cross-sectional view of the vertical rail 18. The vertical rail 18 is formed of a first U-shaped channel member 40 and a second U-shaped channel member 42. The channel members 40 and 42 are made of a metal material, such steel or aluminum, and are fixedly attached to each other (for example, by welding) with the first channel member 40 fitting within the second channel member 42 and the open ends of the two channel members oriented facing each other. The welded attachment may, for example, comprise welding edges or surfaces of the channel member 40 to inner surfaces of the channel member 42. Spot or resistance welding techniques may be used in a manner well known to those skilled in the art. In a preferred implementation, evidence of the welding would not be visible on an outer surface of the channel member 42.

Each channel member 40 and 42 is formed of a web member and an opposed pair of leg members extending generally perpendicularly from the web member. The space between the leg members defines the open end of the channel member. The web member for the first channel member 40 includes a plurality of first openings 46 and the web member for the second channel member 42 includes a plurality of second openings 48. When the channel members 40 and 42 are fixedly attached to each other, the first and second openings 46 and 48 align with each other. Furthermore, with reference once again to FIG. 1, the aligned first and second openings are provided at locations along the lengths of the channel members 40 and 42 which correspond to the desired locations for horizontal cable 20 installation. Indeed, as will be discussed in more detail below, the first and second openings 46 and 48 are provided in connection with supporting the attachment of opposite ends of the plurality of horizontal cables 20 to opposite openings in the vertical rail 18.

The openings 46 and 48 may have any desired shape, but in a preferred implementation the openings have square or rectangular cross-sectional shapes.

The first channel member 40 functions to provide reinforcement or stiffness to the assembly with the second channel member 42 to form the vertical rail 18. The first channel member 40 further functions in connection with supporting vertical rail 18 for retention of ends of the plurality of horizontal cables 20. Also, the first channel member 40 provides space for cable adjustment as will be described herein.

It will be understood that the vertical rail 18 on the left end of the panel 10 has an identical, but mirrored, configuration to the vertical rail 18 on the right end of the panel 10.

Figure 8:
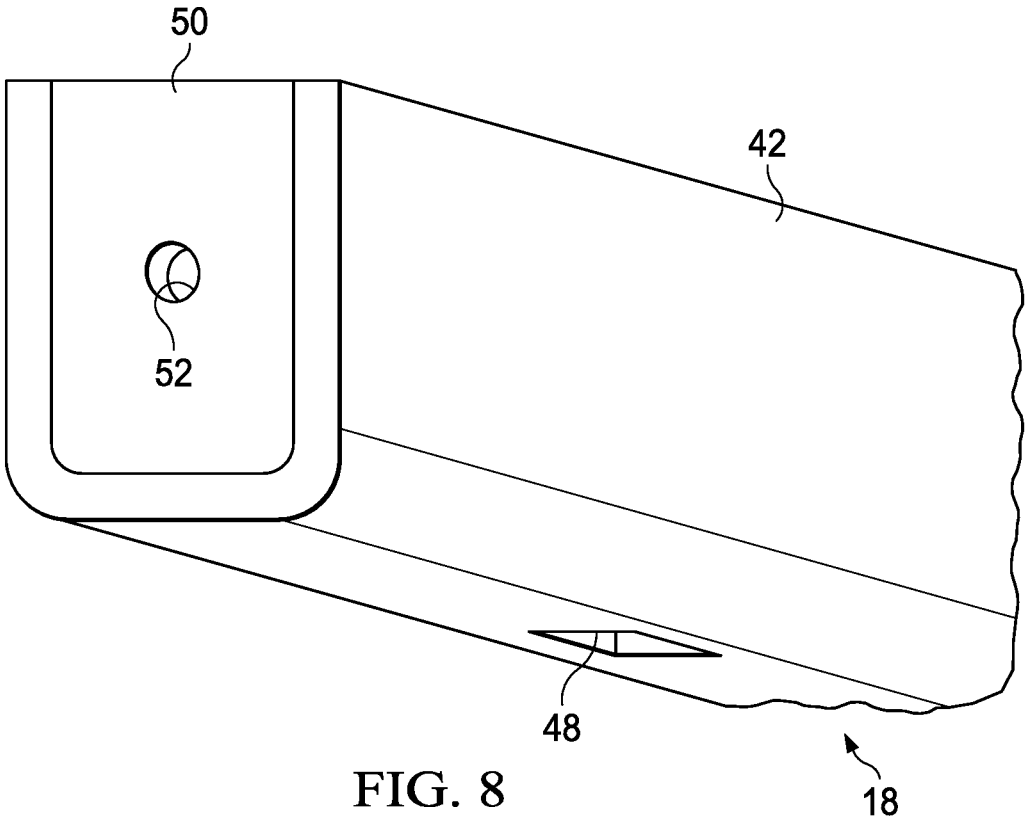

FIG. 8 illustrates a perspective view of the vertical rail 18 with an end cap 50 mounted each end of the channel member 42. A threaded opening 52 is formed each end cap 50. The end cap 50 is secured to the channel member 42 by any suitable means (including, for example, by welding). In a preferred embodiment, the end cap 50 is attached to the channel member 42 in a position where the outer surface of the end cap is flush with the end surface of the channel member 42. In this configuration, it will be understood that the channel member 40 mounted to the channel member 42 will have a slightly shorter length than the channel member 42 in order to account for the thickness of the end cap 50.

Figure 9:
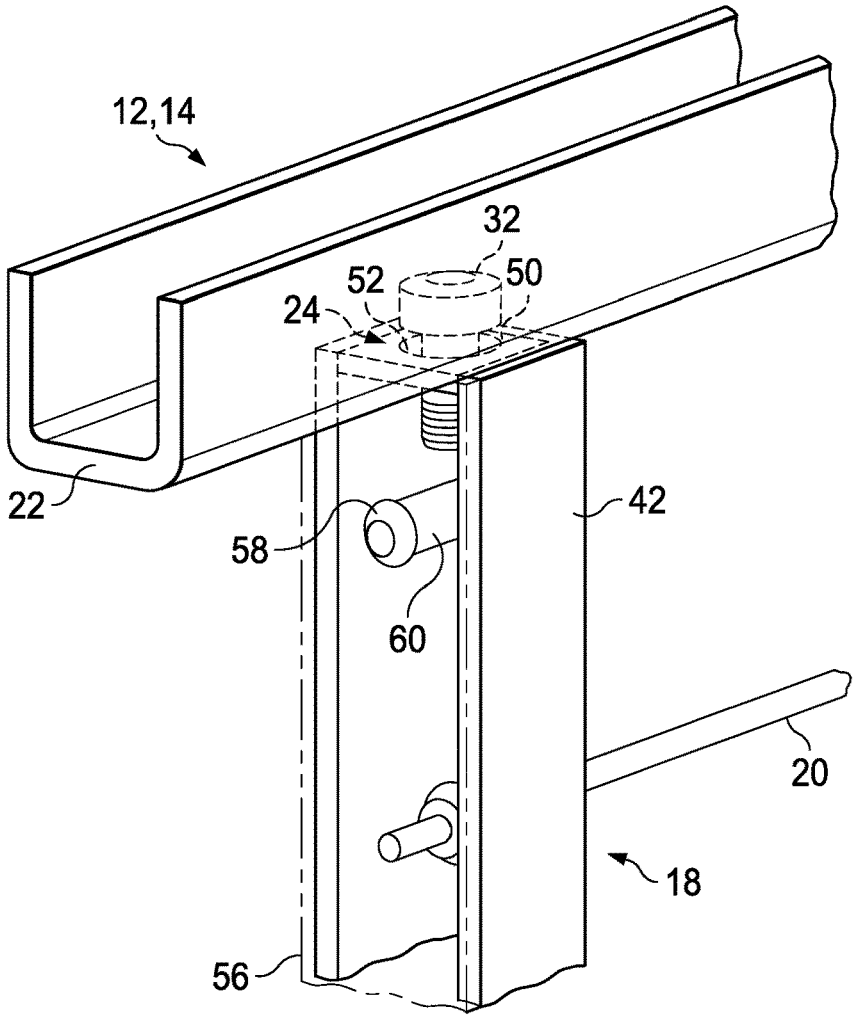
FIG. 9 illustrates details of the assembly of a vertical rail to a top/bottom rail.

Reference is now made to FIG. 9 illustrates details of the assembly of a vertical rail 18 to a top or bottom rail 12 or 14. At selected correspondingly (opposite) positioned ones of the openings 24 at the ends of the rails 12 and 14, attachment is made to the opposed ends of each vertical rail 18. Mounting hardware 32 is used to make the attachment. The mounting hardware 32 may, for example, comprise a bolt, screw or other threaded connector as known in the art with the threaded shaft of the hardware extending through the opening 24 in the rail web to engage the threaded opening 52 provided in the end cap 50 of the vertical rail 18.

Figure 10:
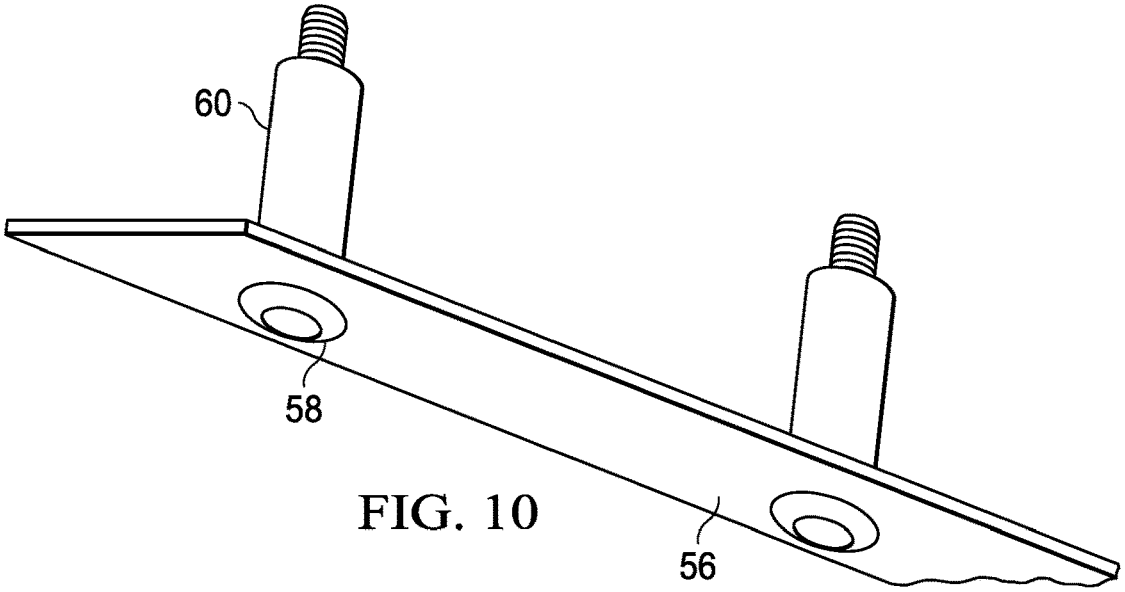
FIG. 10 is a perspective view of a cover plate.

The open end of the channel member 42 for each vertical rail 18 is closed by a cover plate 56 (show in phantom view in FIG. 9 and perspective view in FIG. 10). Mounting hardware 58 is used to secure the cover plate to the vertical rail. The mounting hardware 58 may, for example, comprise a bolt, screw or other threaded connector as known in the art with the threaded shaft of the hardware extending through the cover plate to engage the opening 46 of the channel member 40 for the vertical rail 18. A standoff member 60 of appropriate length is installed on the shaft of the mounting hardware 58 to ensure that the cover plate 56 is properly positioned relative to the open end of the channel member 42.

Figure 11A:
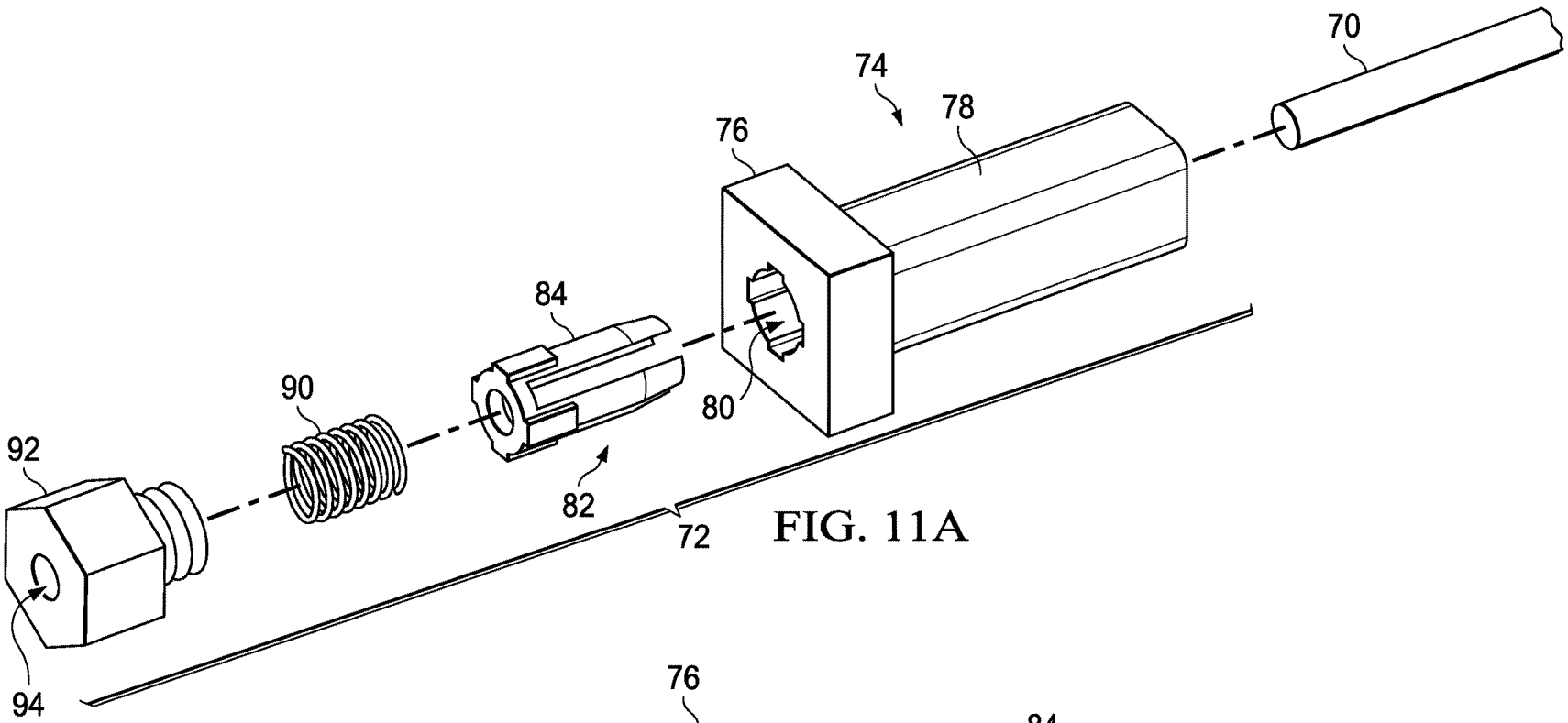
FIGS. 11A and 11C are exploded perspective views of clamping systems to engage a first end of a cable.
Figure 11B:
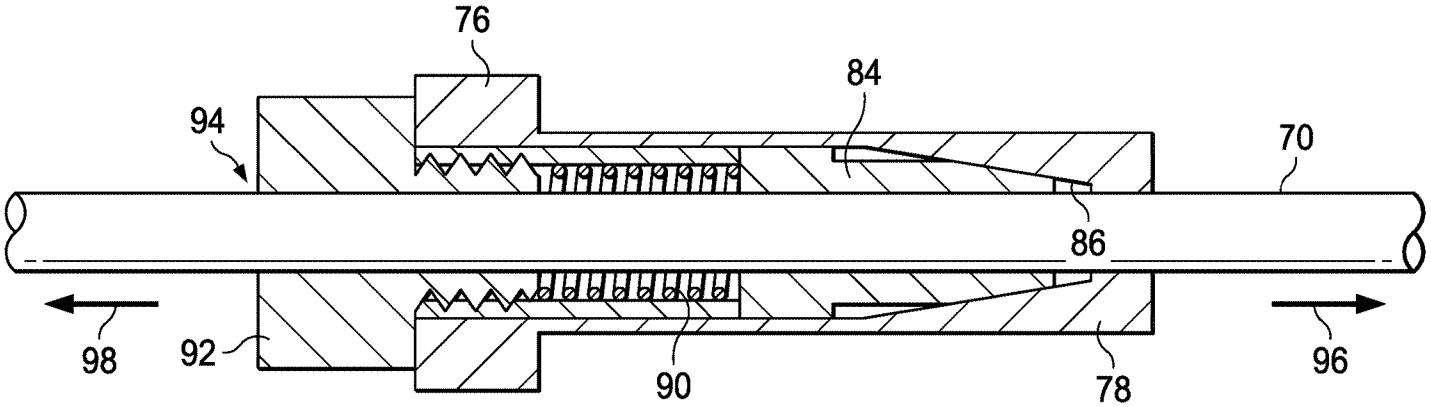
FIG. 11B is an assembled cross-sectional view of the clamping system of FIG. 11A.

Reference is now made to FIG. 11A which illustrates an exploded perspective view of a clamping system configured to engage a first end of the horizontal cable 20. FIG. 11B shows an assembled cross-sectional view. The cable 20 is formed of a cable member 70 that is made of metal, for example, stainless steel. The cable member 70 may be of a wound or woven or solid (rod) type as desired and is to some degree flexible along its length. At the first end, a uni-directional clamp fitting 72 is attached. The fitting 72 includes a body 74 formed of a flange member 76 and a shank member 78. A threaded opening 80 extends through the flange member 76 and shank member 78. The shank member 78 may, for example, have an outer shape in the form of a square or rectangle generally conforming to the size and shape of the openings 46 and 48 provided in the vertical rail 18. The cable member 70 extends through the opening 80. A compression member 82 includes a plurality of fingers 84 which surround the cable member 70. The compression member 82 fits within the opening 80. The opening 80 further includes a tapered portion 86. When the outer surface of the fingers 84 engages the tapered portion 86 of the opening 80, the fingers 84 function to clamp on to the outer surface of the cable member 70. A bias spring 90 is also inserted into the opening. A threaded cap 92 engages the threaded opening 80 and when tightened compresses the bias spring 90 to apply a bias force against the compression member 82. The threaded cap 92 includes an opening 94 extending therethrough. The cable member 70 passes through the opening 94. When biased by the spring 90, the fingers 84 clamp against the cable member 70 and obstruct movement of the cable member 70 in the direction of arrow 96. However, movement of the cable member 70 in the direction of arrow 98 is permitted because such movement of the cable member 70 moves the compression member 82 in the direction of arrow 98 to release the clamping action of fingers 84.

Figure 11C:
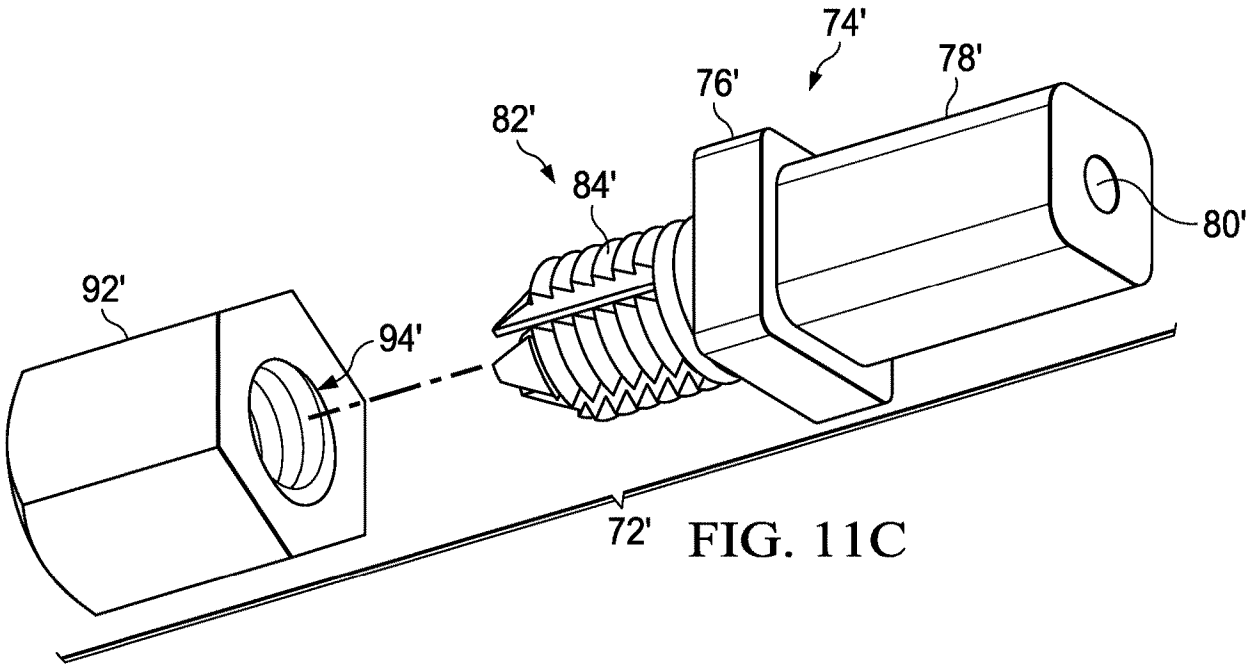
Figure 11D:
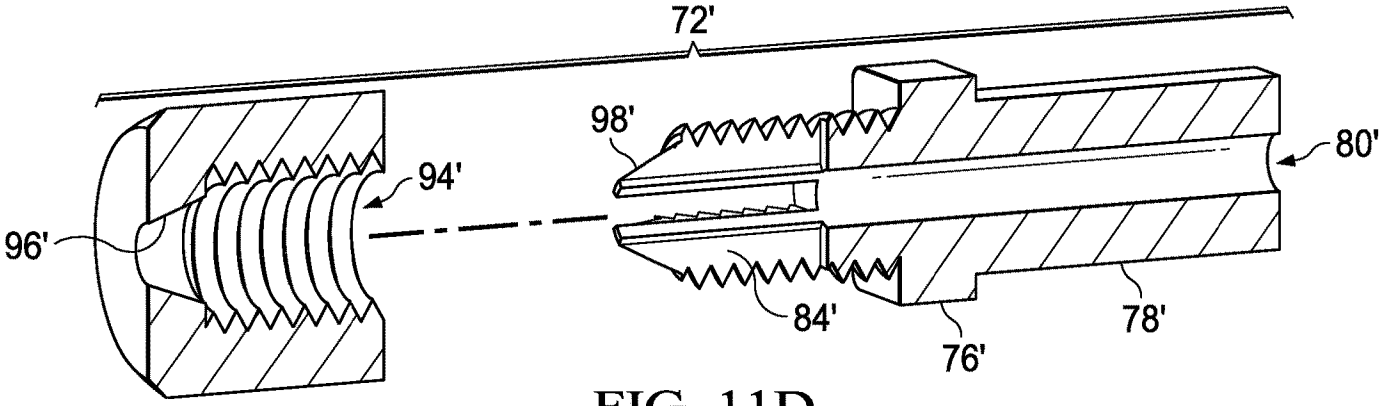
FIG. 11D is an exploded cross-sectional view of the clamping system of FIG. 11C.

Reference is now made to FIG. 11C which illustrates an exploded perspective view of a clamping system configured to engage a first end of the horizontal cable 20. FIG. 11D shows an exploded cross-sectional view. At the first end of cable 20, a clamp fitting 72' is attached. The fitting 72' includes a body 74' formed of a flange member 76' and a shank member 78'. An opening 80' extends through the flange member 76' and shank member 78'. The shank member 78' may, for example, have an outer shape in the form of a square or rectangle generally conforming to the size and shape of the openings 46 and 48 provided in the vertical rail 18. The cable member extends through the opening 80'. The body 74' further includes a compression member 82' formed of a plurality of fingers 84' which surround the cable member. The outer surface of the fingers 84' is threaded. A cap 92' includes a threaded opening 94' extending therethrough. The cable member 70 passes through the opening 94'. The inner diameter of the opening 94' is tapered 96' at one end. When the cap 92' is secured to the compression member 82', the outer tapered surface 98' at the end of the fingers 84' engages the tapered inner surface 96' of the opening 94' causing the fingers to clamp on to the outer surface of the cable member and obstruct any movement of the cable member. However, by loosening the cap 92', movement of the cable member through the fitting 72' is permitted.

Figure 11E:
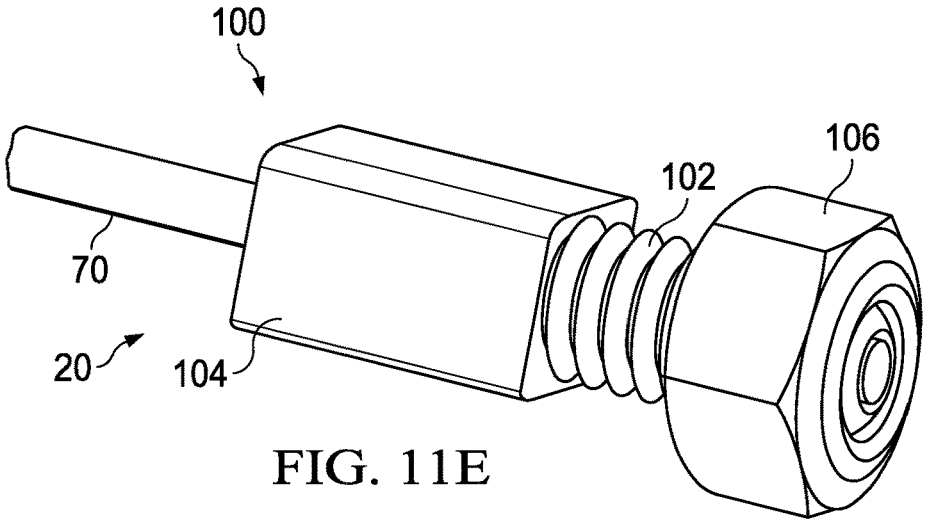
FIG. 11E is a perspective view of a fitting at a second end of the cable.

Reference is now made to FIG. 11E which illustrates a second end of the horizontal cable 20. The cable 20 is formed of the cable member 70 as described above. At the second end, a threaded swage (adjustable) fitting 100 is attached. The threaded swage fitting 100 includes a threaded member 102 and a shank member 104. The shank member 104 is a hollow tubular member sized to receive the end of the cable member 70 which is fixedly attached within the shank member 104. The shank member 104 may, for example, have an outer shape in the form of a square or rectangle generally conforming to the size and shape of the openings 46 and 48 provided in the vertical rail 18. The threaded member 102 likewise is sized to fit through the openings 46 and 68. A nut 106 is provided to be installed on the threaded member 102 and it is sized larger than the openings 46 and 48.

Figure 11F:
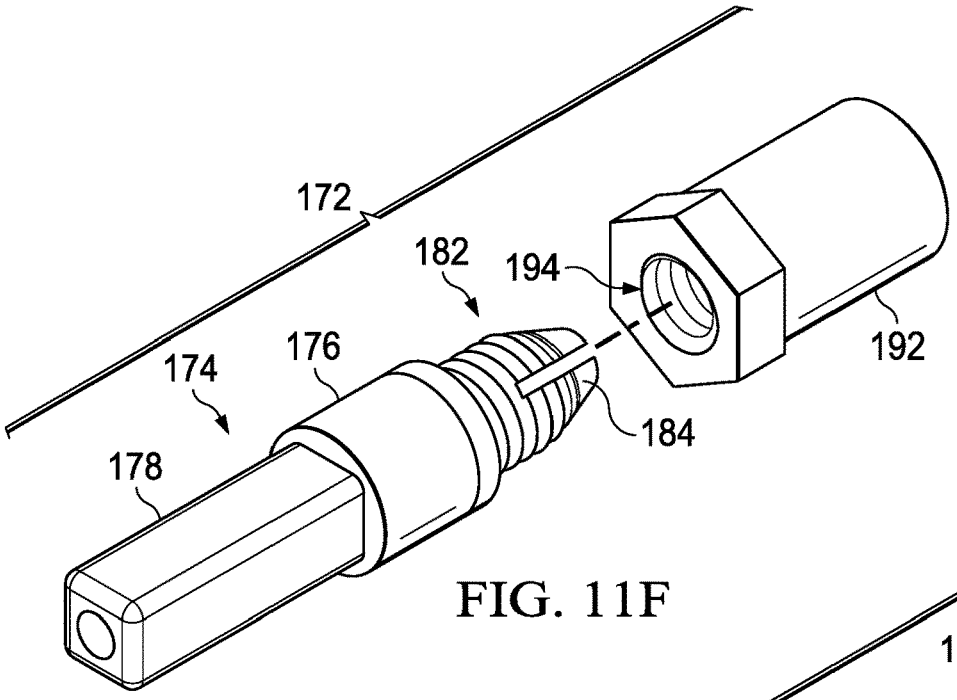
FIGS. 11F-11G are views of an alternative embodiment for a clamping system.
Figure 11G:
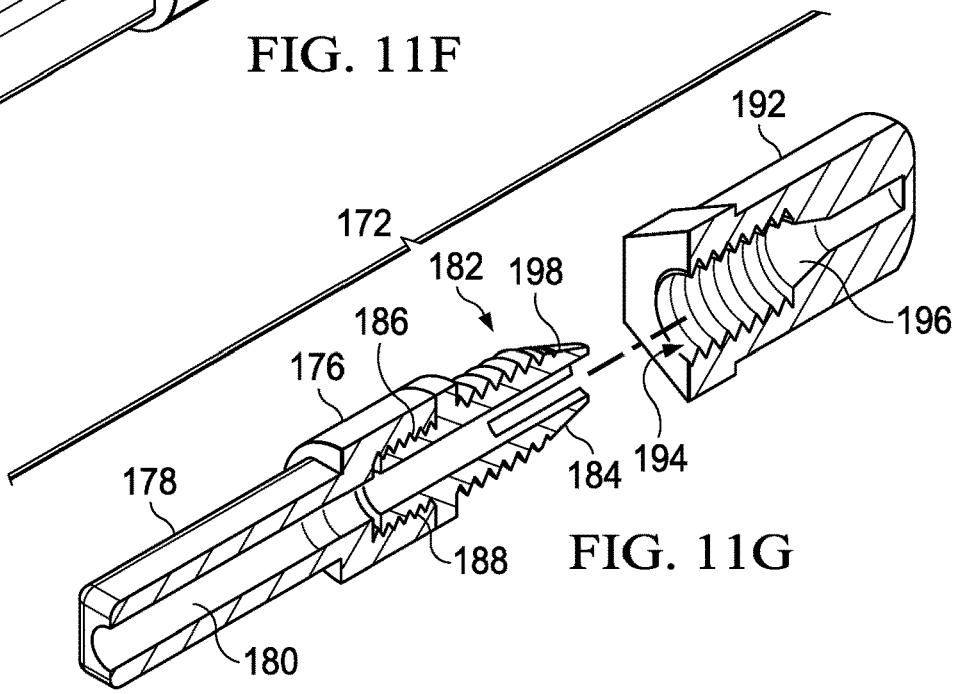

Reference is now made to FIGS. 11F-11G which illustrate an alternative embodiment for a clamping system configured to engage an end of the horizontal cable 20. FIG. 11F shows a perspective view of the clamping system, and FIG. 11G shows a cross-sectional view. At the end of cable 20, a clamp fitting 172 is attached. The fitting 172 includes body 174 formed by a flange member 176 and a shank member 178. An opening 180 extends through the flange member 176 and shank member 178. The shank member 178 may, for example, have an outer shape in the form of a square or rectangle generally conforming to the size and shape of the openings 46 and 48 provided in the vertical rail 18. The cable extends through the opening 180. The fitting 172 further includes a compression member 182 formed of a plurality of fingers 184 which surround the cable member. One end of the compression member 182 is threaded 186 to engage a correspondingly threaded opening 188 of the shank member 178. The outer surface of the fingers 184 is threaded. A cap 192 includes a threaded opening 194. The cable member 70 passes through the opening 194. The inner diameter of the opening 194 is tapered 196 at one end. When the cap 192 is secured to the compression member 182, the outer tapered surface 198 at the end of the fingers 184 engages the tapered inner surface 196 of the opening 194 causing the fingers to clamp on to the outer surface of the cable and obstruct any movement of the cable member. However, by loosening the cap 192, movement of the cable through the fitting 172 is permitted.

Figure 12A:
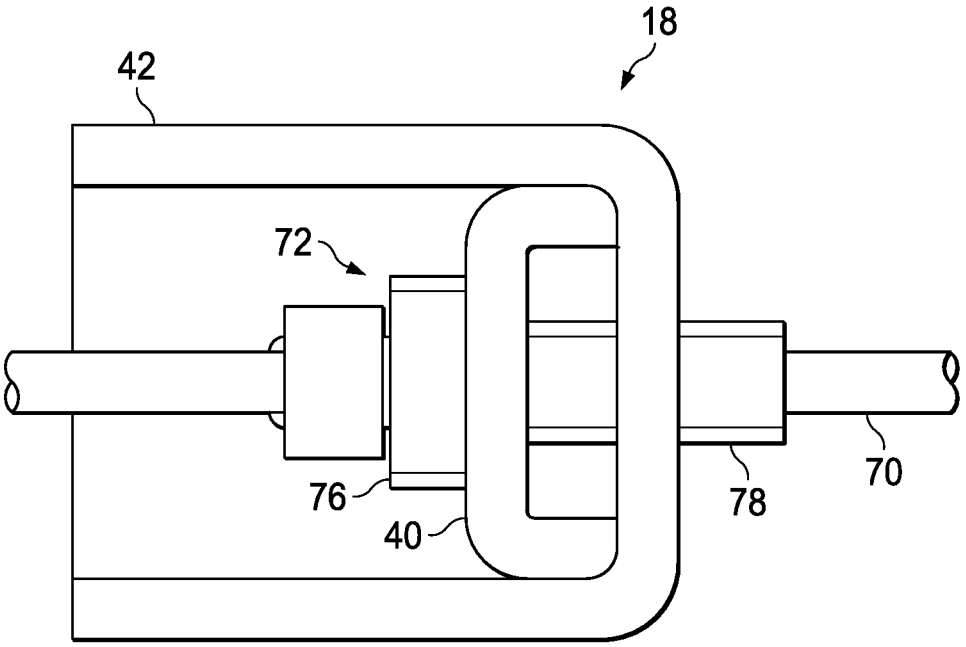
FIG. 12A is an end view of a vertical rail with an installed clamp fitting.
Figure 12B:
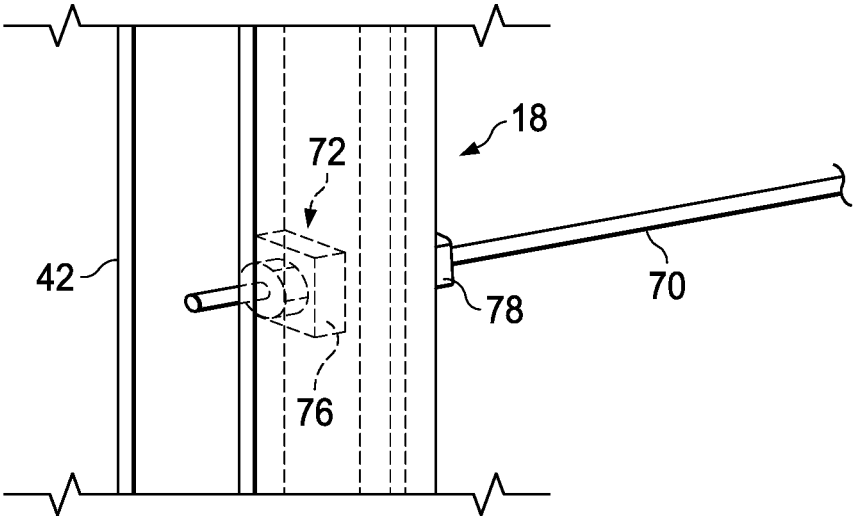
FIG. 12B is a perspective view of the installed clamp fitting.

Reference is now made to FIG. 12A which illustrates an end view of vertical rail 18 with an installed clamp fitting 72 of FIGS. 11A-11B (or clamp fitting 72' of FIGS. 11C-11D). The flange member 76 (or 76') is sized larger than the opening 46 in the first channel member 40 and the shank member 78 (or 78') is sized to pass freely through the openings 46 and 48 in the channel members 40 and 42. FIG. 12B shows a perspective view of the installed clamp fitting 72 (or 72') on vertical rail 18.

Figure 13A:
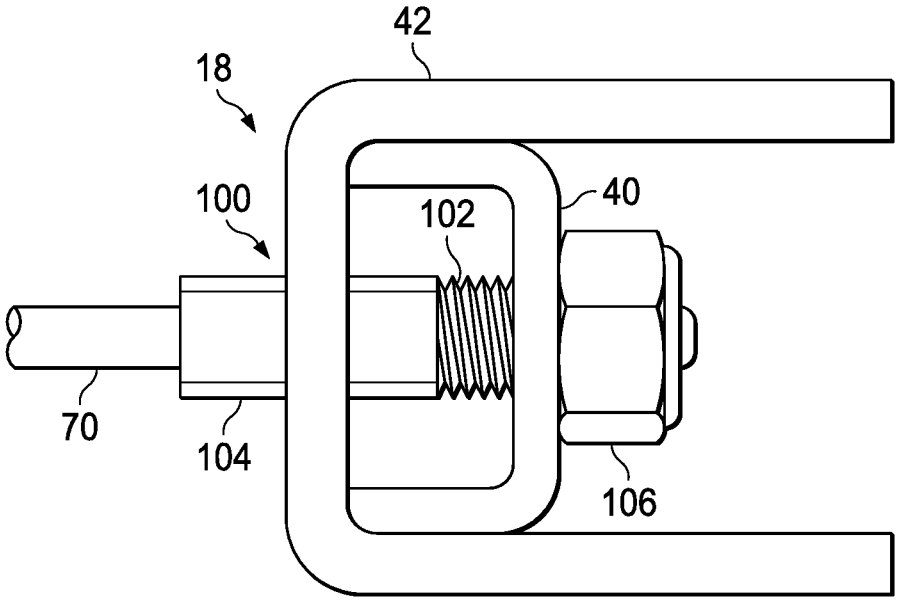
FIG. 13A is an end view of a vertical rail with an installed adjustable fitting.
Figure 13B:
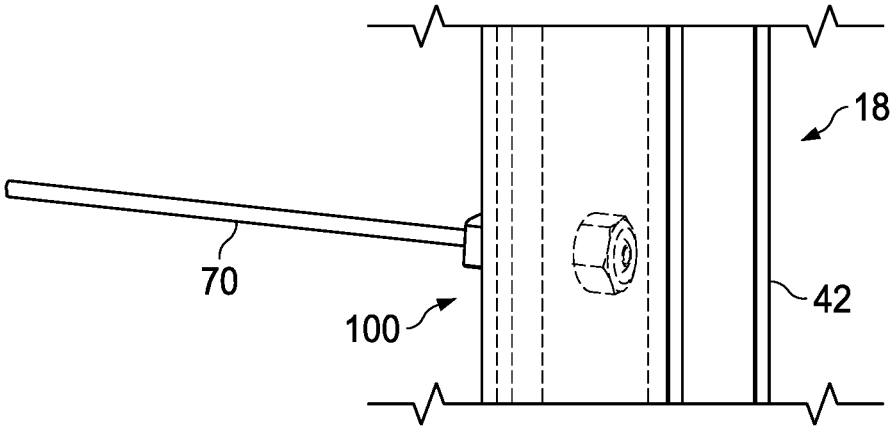
FIG. 13B is a perspective view of the installed adjustable fitting.

Reference is now made to FIG. 13A which illustrates an end view of vertical rail 18 with an installed threaded swage fitting 100 (of FIG. 11E). The nut 106 is sized larger than the opening 46 in the first channel member 40 and the shank member 104 and threaded member 102 are sized to pass freely through the openings 46 and 48 in the channel members 40 and 42. Tightening of the nut 106 on the threaded member 102 permits adjustments to be made as to the tensioning of the cable 20. FIG. 13B shows a perspective view of the installed threaded swage fitting 100 on vertical rail 18.

Figure 14:
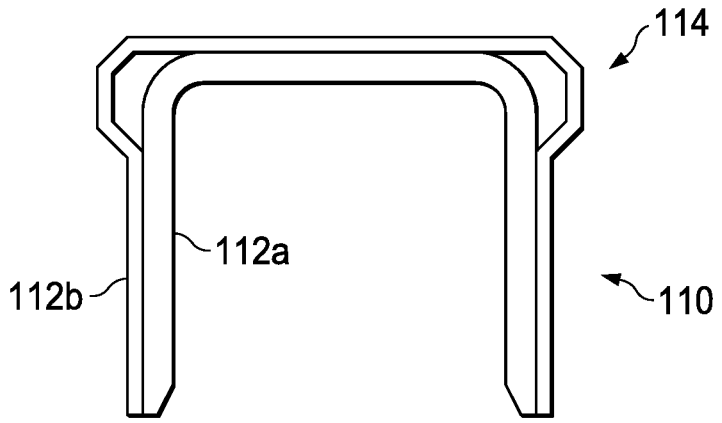
FIG. 14 illustrates an end view of a cap member.
Figure 15:
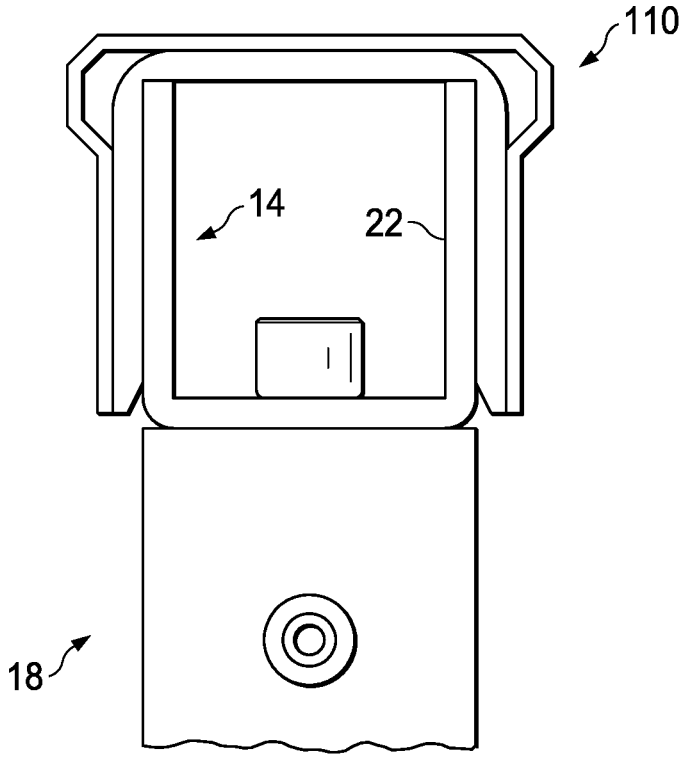
FIG. 15 illustrates installation of the cap member.

Reference is now made to FIG. 14 which illustrates an end view of a cap member 110 that is configured for installation over the top rail 14. FIG. 15 illustrates the cap member 110 in an installed position. The cap member 110 is formed of one or more U-shaped channel members 112 which may comprise a base member 112*a* and an ornamental member 112*b*. The base member 112*a* is designed for press or interference fit over the channel member 22. The ornamental member 112*b* is secured to the base member 112*a* through any suitable means (including, for example, welding, adhesion, etc.) and includes ornamental features 114 as desired (only one non-limiting example of such ornamentation being shown).

Figure 16:
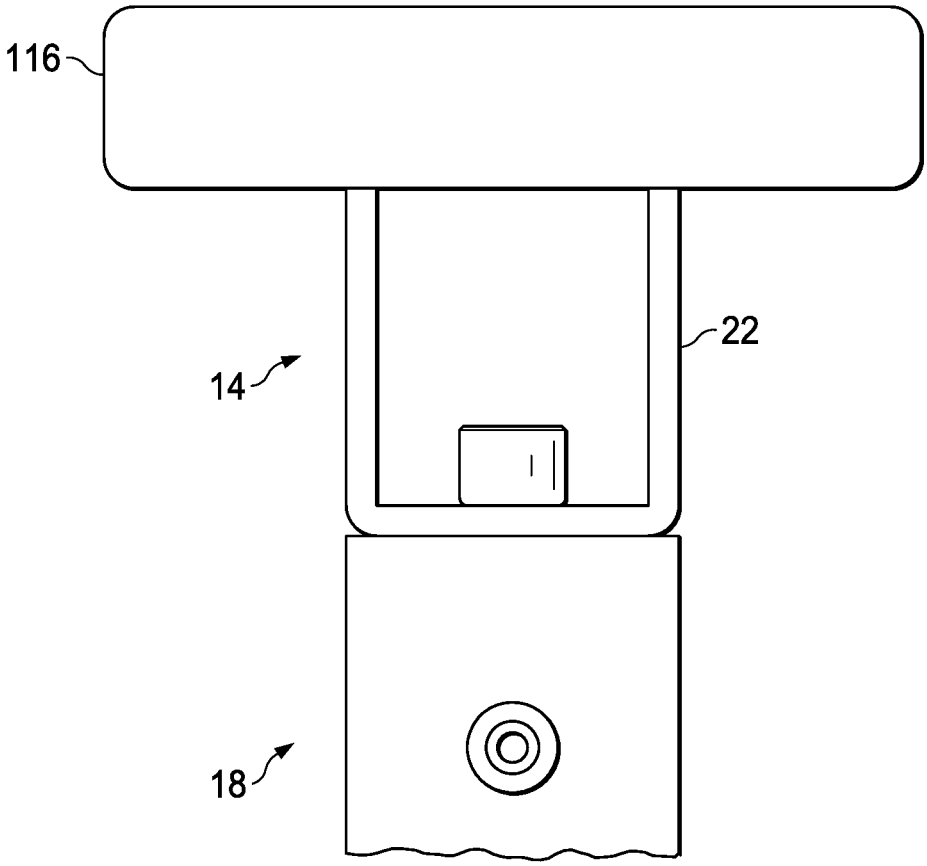
FIG. 16 illustrates an alternative cap member.

In an alternative embodiment, the open end of the top rail 14 may be closed or covered using other means. For example, FIG. 16 illustrates the use of a wooden member 116 which can be secured to the top rail 14 using any suitable means (including, for example, a clip mechanism and hardware attachment).

Figure 17A:
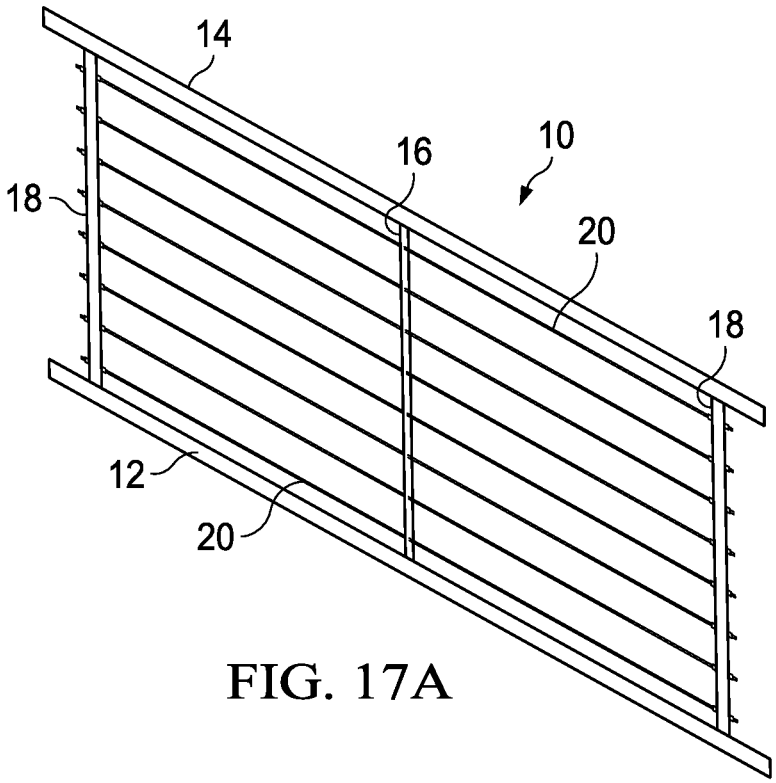
FIGS. 17A-17G illustrate an implementation of the cable rail panel useful in a stair or sloped installation.
Figure 17B:
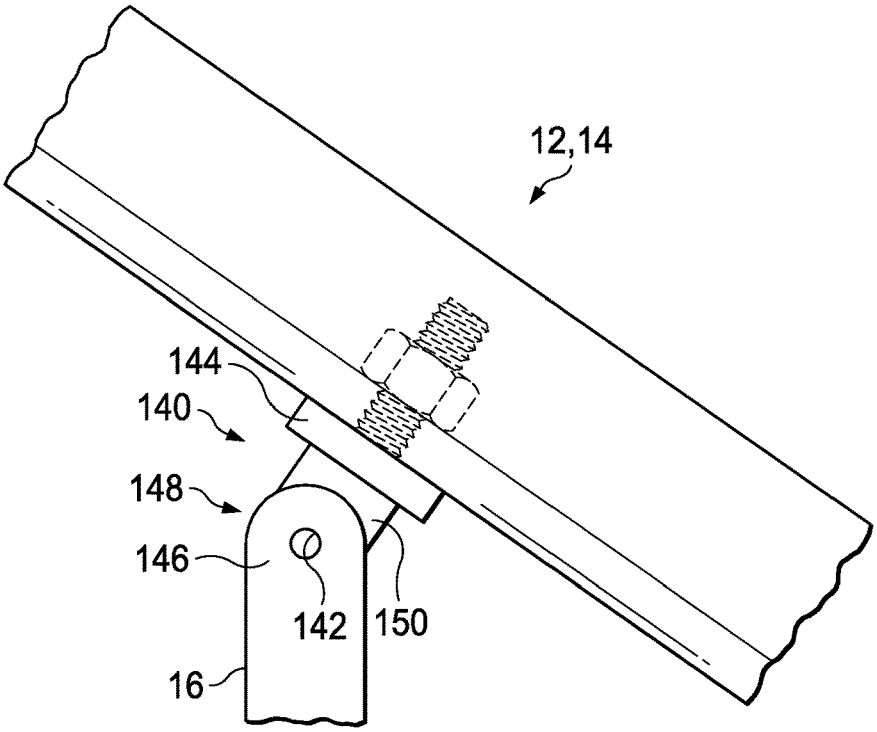
Figure 17C:
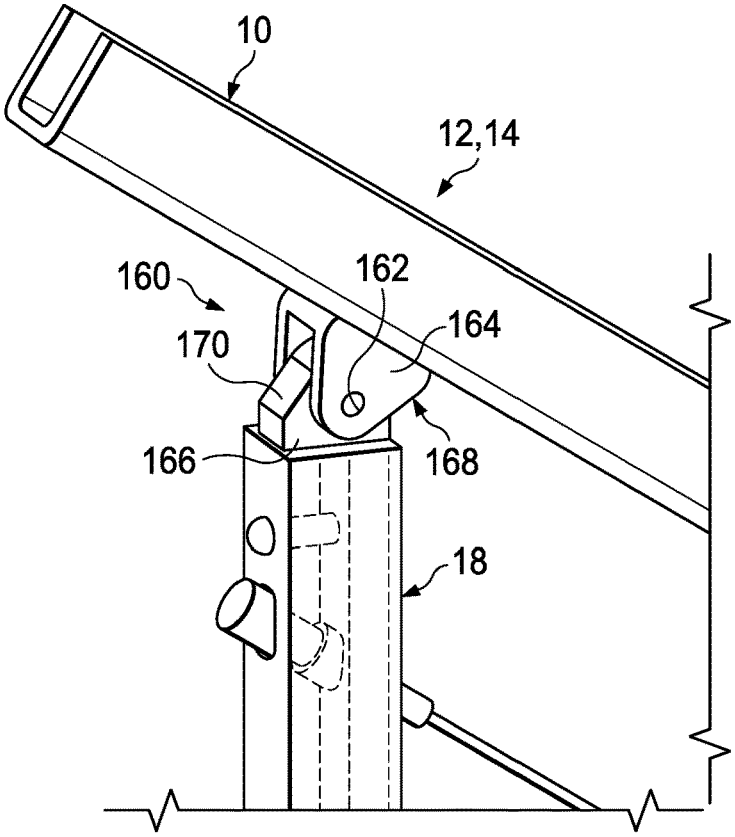
Figure 17D:
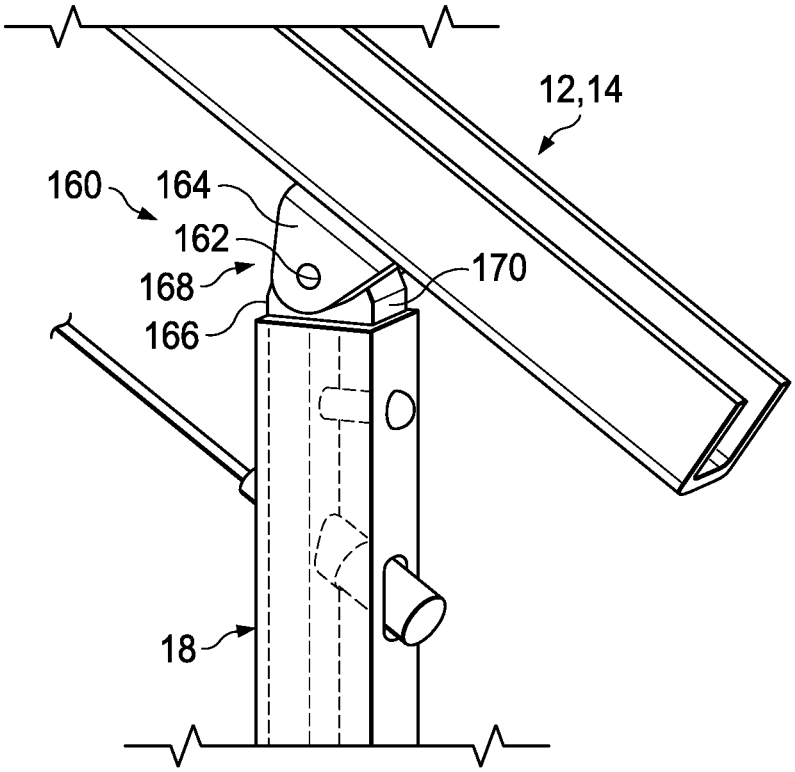
Figure 17E:
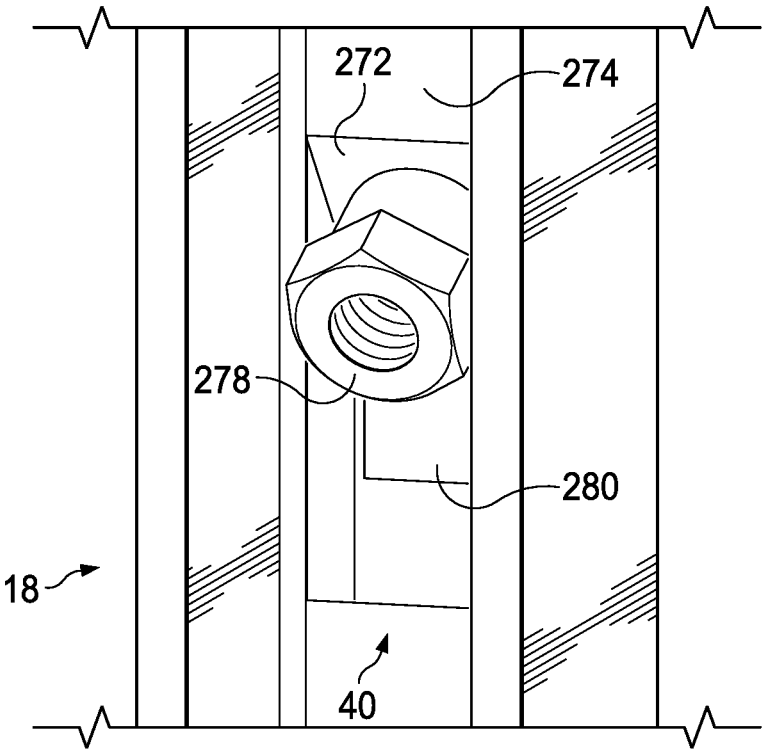
Figure 17F:
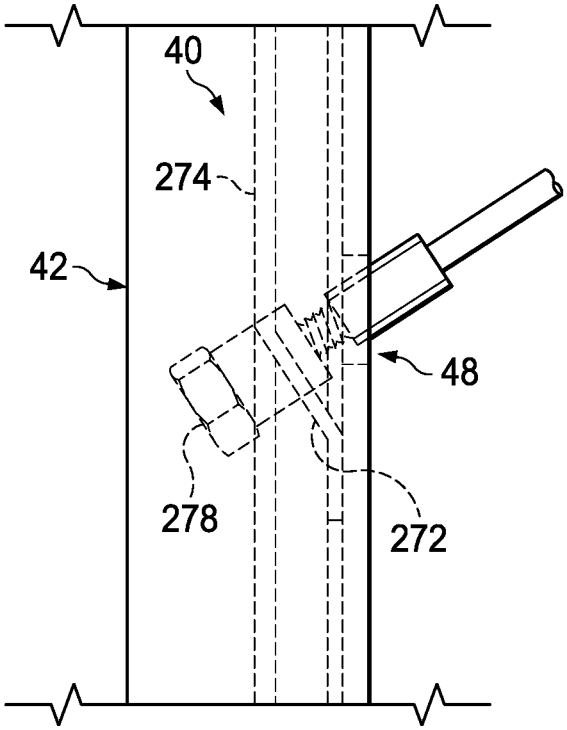
Figure 17G:
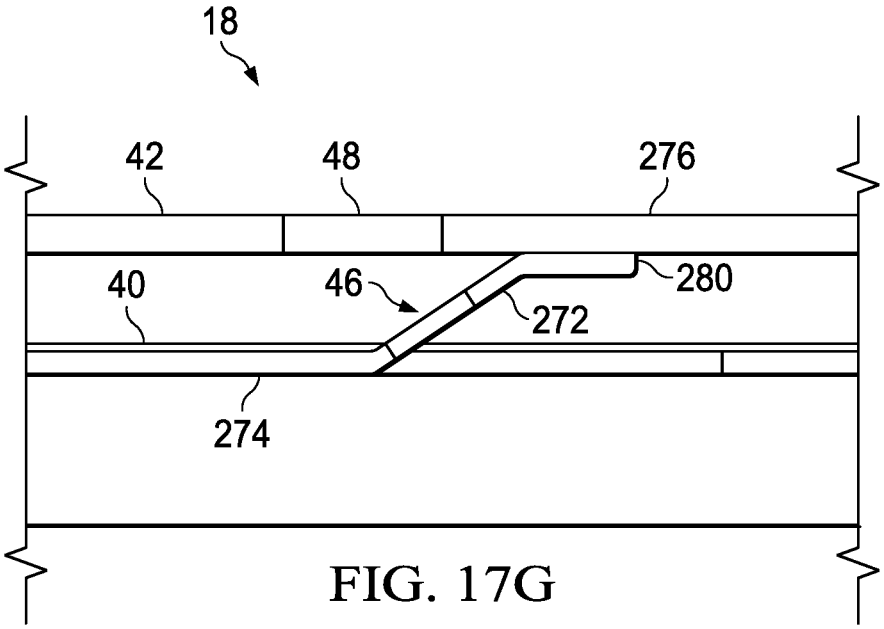

There may exist certain installations, such as with stairs or other sloped terrain, where a perpendicular panel configuration like that shown in FIG. 1 is not preferred. In such cases, it would be preferred to install a panel that is configured to have the top and bottom rails and cables of the panel run parallel to the slope as shown in FIG. 17A.

The panel 10 is accordingly configured to support racking so as to follow undulating terrain, stairways or ramps. For example, the panel may be racked to an angle up to about 35°. In this configuration, the connection between the vertical support members 16 vertical rails 18 and both the bottom rail 12 and top rail 14 permits other than perpendicular mounting. Additionally, the brackets used to attach the ends of the bottom rail 12 and top rail 14 to the posts 8 permits other than perpendicular mounting. More detail is provided below and in connection with FIGS. 17B-17G.

To support this installation, the panel includes a hinge 140 for connecting the ends of the vertical support members 16 to each of the rails 12 and 14. See, FIG. 17B. The hinge 140 provides a pivot point 142 between a rail bracket 144 and a support bracket 146. In the illustrated configuration, the support bracket 146 includes a pair of opposed flanges 148 and the rail bracket 144 includes a tab member 150 that is inserted between and pivotally coupled to the flanges 148. The rail bracket 144 may be attached to the rail 12/14 using the included opening 24 and mounting hardware. The support bracket 146 may be attached to an end of the support member 16 using mounting hardware, or alternatively may be integrally formed at the end of the support member 16.

To further support that installation, the panel includes a hinge 160 for connecting the ends of the vertical rails 18 to each of the rails 12 and 14. See, FIGS. 17C-17D. The hinge 160 provides a pivot point 162 between a first bracket 164 and a second bracket 166. In the illustrated configuration, the first bracket 164 includes a pair of opposed flanges 168 and the second bracket 166 includes a tab member 170 that is inserted between and pivotally coupled to the flanges 168.

In order to support angled attachment of the ends of the cable, the vertical rails 18 are configured such that an angled tab 272 is cut out from the web member 274 of the first channel member 40 at each opening 46. See, FIGS. 17E-17G. A first end of the angled tab 272 remains attached to the web member 274 while a second end of the angled tab 272 is bent inwardly towards the web member 276 of the second channel member 42. In an embodiment, the second end of the angled tab 272 is engaged (for example, welded) against the inner surface of the web 276 for the second channel member 42 (as shown at reference 280). The opening 46 still aligns with the opening 48 on the second channel member 42 and receives the fitting 278 which is attached to the cable end (see, FIGS. 11A-11D for examples of the fittings). The angle with which the tab 272 is bent may, in a preferred embodiment, be equal to about 30-40°. It will be understood that the angle of the tab 272 may be selected to account for the slope of the stairs or sloped terrain at which the panel is to be installed. The alignment of the openings 46 and 48 is made in accordance with a range of permitted slope installations. To support such a range, the opening 48 in the second channel member is oversized with respect to the fitting.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A barrier panel, comprising:

a first vertical rail member defining a plurality of first through holes spaced apart along a length of the first vertical rail member;

a second vertical rail member defining a plurality of second through holes spaced apart along a length of the second vertical rail member;

a top horizontal rail extending at least from the first vertical rail member to the second vertical rail member and a first end of the top horizontal rail extending beyond the first vertical rail member in a first direction and a second end of the top horizontal rail opposite the first end extending beyond the second vertical rail member in a second direction opposite the first direction, the first end configured to be coupled to a first post and the second end being configured to couple to a second post;

a bottom horizontal rail disposed vertically spaced apart from the top horizontal rail and extending at least from the first vertical rail member to the second vertical rail member; and a plurality of cables vertically spaced apart along a length of the first vertical rail member, each cable extending from the first vertical rail member to the second vertical rail member, wherein a first end of each cable is secured within one of the plurality of first through holes and a second end of each cable is secured within one of the plurality of second through holes.

2. The barrier panel of claim 1 wherein a tension of each one of the plurality of cables is independently adjustable.

3. The barrier panel of claim 1 further comprising a plurality of clamp fittings, each clamp fitting secured to the first end of each cable.

4. The barrier panel of claim 1, further comprising a third vertical rail member disposed between the first vertical rail member and the second vertical rail member and defining a plurality of third through holes through which each one of the plurality of cables passes.

5. The barrier panel of claim 1 further comprising a spacer member associated with the first vertical rail member and a nut coupled to the first end of one of the plurality of cables, the nut contacting the spacer member, and wherein turning the nut adjusts a tension of the one of the plurality of cables.

6. The barrier panel of claim 1 wherein the first vertical rail member is U-shaped in profile and further comprising adjustable hardware coupled to the first end of each cable and a cover plate coupled to the first vertical rail member and concealing the adjustable hardware within the first vertical rail member.

7. The barrier panel of claim 1 wherein the bottom horizontal rail includes a first end extending beyond the first vertical rail member in the first direction and a second end of the bottom horizontal rail opposite the first end extending beyond the second vertical rail member in the second direction opposite the first direction, the first end of the bottom horizontal rail configured to be coupled to the first post and the second end of the bottom horizontal rail configured to be coupled to the second post.

8. The barrier panel of claim 1 further comprising a hinge member coupling the first vertical rail member to the top horizontal rail.

9. The barrier panel of claim 1 further comprising at least one vertical support member mounted to and extending between the top and bottom horizontal rails, said vertical support member including a plurality of third through holes spaced apart along a length of the vertical support member, each third through hole having one of said cables extending therethrough, and wherein the vertical support member includes at least one threaded opening disposed at an end of the vertical support member, and further comprising at least one threaded connector configured to engage with the at least one threaded opening of the vertical support member and connect the vertical support member to the top horizontal rail.

10. The barrier panel of claim 1 wherein the top and bottom horizontal rails, the first and second vertical rail members, and the plurality of cables are pre-assembled to form a pre-assembled barrier panel.

11. A barrier panel, comprising:

a first vertical rail member defining a plurality of first through holes spaced apart along a length of the first vertical rail member;

a second vertical rail member defining a plurality of second through holes spaced apart along a length of the second vertical rail member;

a top horizontal rail extending at least from the first vertical rail member to the second vertical rail member and a first end of the top horizontal rail extending beyond the first vertical rail member in a first direction and a second end of the top horizontal rail opposite the first end extending beyond the second vertical rail member in a second direction opposite the first direction, the first end configured to be coupled to a first post and the second end being configured to be coupled to a second post;

a bottom horizontal rail disposed vertically spaced apart from the top horizontal rail and extending at least from the first vertical rail member to the second vertical rail member, wherein the bottom horizontal rail includes a first end extending beyond the first vertical rail member in the first direction and a second end of the bottom horizontal rail opposite the first end of the bottom horizontal rail extending beyond the second vertical rail member in the second direction opposite the first direction, the first end of the bottom horizontal rail configured to be coupled to the first post and the second end of the bottom horizontal rail configured to be coupled to the second post;

a plurality of cables vertically spaced apart along a length of the first vertical rail member, each cable extending from the first vertical rail member to the second vertical rail member, wherein a first end of each cable is secured within one of the plurality of first through holes and a second end of each cable is secured within one of the plurality of second through holes; and wherein a tension of each one of the plurality of cables is independently adjustable.

12. The barrier panel of claim 11 further comprising a plurality of clamp fittings, each clamp fitting secured to the first end of each cable.

13. The barrier panel of claim 11, further comprising a third vertical rail member disposed between the first vertical rail member and the second vertical rail member and defining a plurality of third through holes through which each one of the plurality of cables passes.

14. The barrier panel of claim 11 further comprising a spacer member associated with the first vertical rail member and a nut coupled to the first end of one of the plurality of cables, the nut contacting the spacer member, and wherein turning the nut adjusts the tension of the one of the plurality of cables.

15. The barrier panel of claim 14 wherein the first vertical rail member is U-shaped in profile and further comprising adjustable hardware coupled to the first end of each cable and a cover plate coupled to the first vertical rail member and concealing the adjustable hardware within the first vertical rail member.

16. The barrier panel of claim 11 further comprising a hinge member coupling the first vertical rail member to the top horizontal rail.

17. The barrier panel of claim 11 further comprising at least one vertical support member mounted to and extending between the top and bottom horizontal rails, said vertical support member including a plurality of third through holes spaced apart along a length of the vertical support member, each third through hole having one of said cables extending therethrough, and wherein the vertical support member includes at least one threaded opening disposed at an end of the vertical support member, and further comprising at least one threaded connector configured to engage with the at least one threaded opening of the vertical support member and connect the vertical support member to the top horizontal rail.

18. The barrier panel of claim 11 wherein the top and bottom horizontal rails, the first and second vertical rail members, and the plurality of cables are pre-assembled to form a pre-assembled barrier panel.

19. A rail panel, comprising:

a first vertical rail member defining a plurality of first through holes spaced apart along a length of the first vertical rail member;

a second vertical rail member defining a plurality of second through holes spaced apart along a length of the second vertical rail member;

a top horizontal rail extending at least from the first vertical rail member to the second vertical rail member and a first end of the top horizontal rail extending beyond the first vertical rail member in a first direction and a second end of the top horizontal rail opposite the first end extending beyond the second vertical rail member in a second direction opposite the first direction, the first end configured to be coupled to a first post and the second end being configured to couple to a second post;

a bottom horizontal rail disposed vertically spaced apart from the top horizontal rail and extending at least from the first vertical rail member to the second vertical rail member;

a plurality of cables vertically spaced apart along a length of the first vertical rail member, each cable extending from the first vertical rail member to the second vertical rail member, wherein a first end of each cable is secured within one of the plurality of first through holes and a second end of each cable is secured within one of the plurality of second through holes;

a third vertical rail member disposed between the first vertical rail member and the second vertical rail member and defining a plurality of third through holes through which each one of the plurality of cables passes; and wherein the top and bottom horizontal rails, the first, second, and third vertical rail members, and the plurality of cables are pre-assembled to form a pre-assembled rail panel.

20. The rail panel of claim 19 wherein a tension of each one of the plurality of cables is independently adjustable.

* * * * *